US006178704B1

(12) United States Patent
Sievert

(10) Patent No.: US 6,178,704 B1
(45) Date of Patent: Jan. 30, 2001

(54) SPLITTING TECHNIQUE

(75) Inventor: Dick J. Sievert, New Richmond, WI (US)

(73) Assignee: Anchor Wall Systems, Inc., Minnetonka, MN (US)

( * ) Notice: Under 35 U.S.C. 154(b), the term of this patent shall be extended for 0 days.

(21) Appl. No.: 09/346,185

(22) Filed: Jul. 1, 1999

Related U.S. Application Data

(63) Continuation of application No. 08/774,247, filed on Nov. 8, 1996.

(51) Int. Cl.[7] ..... E04C 1/00

(52) U.S. Cl. ..... 52/100; 52/596; 52/605; 52/609; 52/745.19

(58) Field of Search ..... 52/98, 100, 596, 52/604–609, 745.19; 405/286; D25/113, 115

(56) References Cited

U.S. PATENT DOCUMENTS

| | | |
|---|---|---|
| Re. 34,314 | 7/1993 | Forsberg . |
| 126,547 | 5/1872 | Hickcox . |
| 228,052 | 5/1880 | Frost . |
| D. 237,704 | 11/1975 | Lane . |
| D. 279,033 | 5/1985 | Risi et al. . |
| D. 280,024 | 8/1985 | Risi et al. . |
| D. 284,109 | 6/1986 | Seal, Jr. . |
| D. 295,788 | 5/1988 | Forsberg . |
| D. 295,790 | 5/1988 | Forsberg . |
| D. 296,007 | 5/1988 | Forsberg . |
| D. 296,365 | 6/1988 | Forsberg . |
| D. 297,464 | 8/1988 | Forsberg . |
| D. 297,574 | 9/1988 | Forsberg . |
| D. 297,767 | 9/1988 | Forsberg . |
| D. 298,463 | 11/1988 | Forsberg . |
| D. 299,067 | 12/1988 | Forsberg . |
| D. 299,069 | 12/1988 | Risi et al. . |
| D. 300,253 | 3/1989 | Forsberg . |
| D. 300,254 | 3/1989 | Forsberg . |
| D. 301,064 | 5/1989 | Forsberg . |
| D. 311,444 | 10/1990 | Forsberg . |
| D. 316,904 | 5/1991 | Forsberg . |
| D. 317,048 | 5/1991 | Forsberg . |
| D. 317,209 | 5/1991 | Forsberg . |
| D. 319,885 | 9/1991 | Blomquist et al. . |
| D. 340,293 * | 10/1993 | Risi et al. . |
| D. 363,787 | 10/1995 | Powell . |
| 468,838 | 2/1892 | Steiger . |
| 566,924 | 9/1896 | Morrin . |
| 810,748 | 1/1906 | Haller et al. . |
| 831,077 | 9/1906 | Johnson . |
| 847,476 | 3/1907 | Hodges . |
| 884,354 | 4/1908 | Bertrand . |
| 916,756 | 3/1909 | Grant . |
| 1,002,161 | 8/1911 | Lambert . |
| 1,092,621 | 4/1914 | Worner . |

(List continued on next page.)

FOREIGN PATENT DOCUMENTS

| | | |
|---|---|---|
| 2744/26 | of 1927 | (AU) . |
| 22397/83 | 6/1985 | (AU) . |
| 548 462 | 12/1985 | (AU) . |
| 67477/81 | 12/1985 | (AU) . |

(List continued on next page.)

OTHER PUBLICATIONS

Sweet's Engineering & Retrofit Catalog, Sec. 02276/And; pp. 1 and 2; Diamond Beveled Block (1994).

*Aztech Wall System* Installation Guide, Block Systems, Inc. (1989).

(List continued on next page.)

*Primary Examiner*—Robert Canfield

(57) ABSTRACT

A concrete masonry unit having a top surface with a splitting pattern formed therein. The splitting pattern has a splitting groove which intersects at least one recessed region formed in the top surface.

24 Claims, 5 Drawing Sheets

U.S. PATENT DOCUMENTS

| | | |
|---|---|---|
| 1,219,127 | 3/1917 | Marshall . |
| 1,222,061 | 4/1917 | Bartells . |
| 1,248,070 | 11/1917 | Buente . |
| 1,285,458 | 11/1918 | Strunk . |
| 1,287,055 | 12/1918 | Lehman . |
| 1,330,884 | 2/1920 | McDermott . |
| 1,414,444 | 5/1922 | Straight . |
| 1,419,805 | 6/1922 | Bigler . |
| 1,456,498 | 5/1923 | Binns . |
| 1,465,608 | 8/1923 | McCoy . |
| 1,472,917 | 11/1923 | Laird . |
| 1,534,353 | 4/1925 | Besser . |
| 1,557,946 | 10/1925 | Smith . |
| 1,695,997 | 12/1928 | Evers et al. . |
| 1,727,363 | 9/1929 | Bone . |
| 1,733,790 | 10/1929 | Gilman . |
| 1,751,028 | 3/1930 | Caswell et al. . |
| 1,773,579 | 8/1930 | Flath . |
| 1,872,522 | 8/1932 | Stuckey . |
| 1,907,053 | 5/1933 | Flath . |
| 1,993,291 | 5/1935 | Vermont . |
| 2,011,531 | 8/1935 | Tranchell . |
| 2,034,851 | 3/1936 | Wichmann . |
| 2,094,167 | 9/1937 | Evers . |
| 2,113,076 | 4/1938 | Bruce . |
| 2,121,450 | 6/1938 | Sentrop . |
| 2,149,957 | 3/1939 | Dawson . |
| 2,197,960 | 4/1940 | Alexander . |
| 2,219,606 | 10/1940 | Schoick . |
| 2,235,646 | 3/1941 | Schaffer . |
| 2,313,363 | 3/1943 | Schmitt . |
| 2,371,201 | 3/1945 | Wells . |
| 2,570,384 | 10/1951 | Russell . |
| 2,593,606 | 4/1952 | Price . |
| 2,683,916 | 7/1954 | Kelly . |
| 2,881,753 | 4/1959 | Entz . |
| 2,882,689 | 4/1959 | Huch et al. . |
| 2,892,340 | 6/1959 | Fort . |
| 2,925,080 | 2/1960 | Smith . |
| 2,963,828 | 12/1960 | Belliveau . |
| 3,036,407 | 5/1962 | Dixon . |
| 3,185,432 | 5/1965 | Hager, Jr. . |
| 3,204,316 | 9/1965 | Jackson . |
| 3,274,742 | 9/1966 | Paul, Jr. et al. . |
| 3,378,885 | 4/1968 | Dart . |
| 3,386,503 | 6/1968 | Corning et al. . |
| 3,390,502 | 7/1968 | Carroll . |
| 3,392,719 | 7/1968 | Clanton et al. . |
| 3,430,404 | 3/1969 | Muse . |
| 3,488,964 | 1/1970 | Kubo . |
| 3,557,505 | 1/1971 | Kaul . |
| 3,631,682 | 1/1972 | Hilfker et al. . |
| 3,659,077 | 4/1972 | Olson . |
| 3,667,186 | 6/1972 | Kato . |
| 3,754,499 | 8/1973 | Heisman et al. . |
| 3,783,566 | 1/1974 | Nielson . |
| 3,888,060 | 6/1975 | Haener . |
| 3,925,994 | 12/1975 | Broms et al. . |
| 3,932,098 | 1/1976 | Huber et al. . |
| 3,936,987 | 2/1976 | Calvin . |
| 3,936,989 | 2/1976 | Hancock . |
| 3,953,979 | 5/1976 | Kurose . |
| 3,981,038 | 9/1976 | Vidal . |
| 3,995,434 | 12/1976 | Kato et al. . |
| 3,996,389 | 12/1976 | Osborne . |
| 4,001,988 | 1/1977 | Riefler . |
| 4,016,693 | 4/1977 | Warren . |
| 4,023,767 | 5/1977 | Fontana . |
| 4,051,570 | 10/1977 | Hilfiker . |
| 4,067,166 | 1/1978 | Sheahan . |
| 4,083,190 | 4/1978 | Pey . |
| 4,098,040 | 7/1978 | Riefler . |
| 4,107,894 | 8/1978 | Mullins . |
| 4,110,949 | 9/1978 | Cambiuzzi et al. . |
| 4,114,773 | 9/1978 | Sekiguchi . |
| 4,124,961 | 11/1978 | Habegger . |
| 4,126,979 | 11/1978 | Hancock . |
| 4,132,492 | 1/1979 | Jenkins . |
| 4,145,454 | 3/1979 | Dea et al. . |
| 4,175,888 | 11/1979 | Ijima . |
| 4,186,540 | 2/1980 | Mullins . |
| 4,187,069 | 2/1980 | Mullins . |
| 4,190,384 | 2/1980 | Neumann . |
| 4,193,718 | 3/1980 | Wahrendorf et al. . |
| 4,207,718 | 6/1980 | Scaaf et al. . |
| 4,208,850 | 6/1980 | Collier . |
| 4,214,655 | 7/1980 | Bernham et al. . |
| 4,218,206 | 8/1980 | Mullins . |
| 4,228,628 | 10/1980 | Schlomann . |
| 4,229,123 | 10/1980 | Heinzmann . |
| 4,238,105 | 12/1980 | West . |
| 4,242,299 | 12/1980 | Adams . |
| 4,250,863 | 2/1981 | Gagnon et al. . |
| 4,262,463 | 4/1981 | Hapel . |
| 4,288,960 | 9/1981 | Auras . |
| 4,312,606 | 1/1982 | Sarikelle . |
| 4,314,431 | 2/1982 | Rabassa . |
| 4,319,440 | 3/1982 | Rassias et al. . |
| 4,324,505 | 4/1982 | Hammett . |
| 4,335,549 | 6/1982 | Dean, Jr. . |
| 4,337,605 | 7/1982 | Tudek . |
| 4,372,091 | 2/1983 | Brown et al. . |
| 4,380,091 | 4/1983 | Lively . |
| 4,380,409 | 4/1983 | O'Neill . |
| 4,384,810 | 5/1983 | Neumann . |
| 4,426,176 | 1/1984 | Terada . |
| 4,426,815 | 1/1984 | Brown . |
| 4,449,857 | 5/1984 | Davis . |
| 4,454,699 | 6/1984 | Strobl . |
| 4,470,728 | 9/1984 | Broadbent . |
| 4,490,075 | 12/1984 | Risi et al. . |
| 4,496,266 | 1/1985 | Ruckstuhl . |
| 4,512,685 | 4/1985 | Hegle . |
| 4,524,551 | 6/1985 | Scheiwiller . |
| 4,572,699 | 2/1986 | Rinniger . |
| 4,616,959 | 10/1986 | Hilfiker . |
| 4,640,071 | 2/1987 | Haener . |
| 4,651,485 | 3/1987 | Osborne . |
| 4,658,541 | 4/1987 | Haile . |
| 4,659,304 | 4/1987 | Day . |
| 4,660,342 | 4/1987 | Salisbury . |
| 4,661,023 | 4/1987 | Hilfiker . |
| 4,671,706 | 6/1987 | Giardini . |
| 4,684,294 | 8/1987 | O'Neill . |
| 4,698,949 | 10/1987 | Dietrich . |
| 4,711,606 | 12/1987 | Leling et al. . |
| 4,721,847 | 1/1988 | Leverenz . |
| 4,726,567 | 2/1988 | Greenberg . |
| 4,728,227 | 3/1988 | Wilson et al. . |
| 4,738,059 | 4/1988 | Dean, Jr. . |
| 4,745,720 | 5/1988 | Taylor . |
| 4,770,218 | 9/1988 | Duerr . |
| 4,784,821 | 11/1988 | Leopold . |
| 4,802,320 | 2/1989 | Forsberg . |
| 4,802,836 | 2/1989 | Whissell . |
| 4,815,897 | 3/1989 | Risi et al. . |
| 4,824,293 | 4/1989 | Brown et al. . |
| 4,825,619 | 5/1989 | Forsberg . |
| 4,860,505 | 8/1989 | Bender . |
| 4,884,921 | 12/1989 | Smith . |
| 4,896,472 | 1/1990 | Hunt . |

| | | | |
|---|---|---|---|
| 4,896,999 | | 1/1990 | Ruckstuhl . |
| 4,909,010 | | 3/1990 | Gravier . |
| 4,909,717 | | 3/1990 | Pardo . |
| 4,914,876 | | 4/1990 | Forsberg . |
| 4,936,712 | | 6/1990 | Glickman . |
| 4,964,761 | | 10/1990 | Rossi . |
| 4,965,979 | | 10/1990 | Larrivee et al. . |
| 4,990,032 | | 2/1991 | Smith . |
| 5,017,049 | | 5/1991 | Sievert . |
| 5,031,376 | | 7/1991 | Bender et al. . |
| 5,044,834 | | 9/1991 | Janopaul, Jr. . |
| 5,062,610 | | 11/1991 | Woolford et al. . |
| 5,104,594 | | 4/1992 | Hillemeier et al. . |
| 5,125,815 | | 6/1992 | Kargarzadeh et al. . |
| 5,139,721 | | 8/1992 | Castonguay et al. . |
| 5,158,132 | | 10/1992 | Guillemot . |
| 5,161,918 | | 11/1992 | Hodel . |
| 5,249,950 | | 10/1993 | Woolford . |
| 5,261,806 | | 11/1993 | Pleasant . |
| 5,294,216 | | 3/1994 | Sievert . |
| 5,337,527 | | 8/1994 | Wagenaar . |
| 5,353,569 | | 10/1994 | Rodrique . |
| 5,421,034 | | 6/1995 | Keune . |
| 5,421,135 | | 6/1995 | Stevens et al. . |
| 5,484,236 | | 1/1996 | Gravier . |
| 5,490,363 | | 2/1996 | Woolford . |
| 5,505,034 | | 4/1996 | Dueck . |
| 5,540,525 | | 7/1996 | Miller et al. . |
| 5,598,679 | | 2/1997 | Orton et al. . |
| 5,622,456 | | 4/1997 | Risi et al. . |
| 5,653,558 | | 8/1997 | Price . |
| 5,688,079 | | 11/1997 | Bolduc et al. . |
| 5,704,183 | | 1/1998 | Woolford . |
| 6,029,943 | * | 2/2000 | Sievert . |
| 6,082,057 | * | 7/2000 | Sievert ..... 52/100 |

FOREIGN PATENT DOCUMENTS

| | | |
|---|---|---|
| 52765/86 | 8/1986 | (AU) . |
| 80775/87 | 4/1988 | (AU) . |
| 528788 | 5/1954 | (BE) . |
| 338139 | 12/1933 | (CA) . |
| 531354 | 10/1958 | (CA) . |
| D. 65896 | 4/1970 | (CA) . |
| 941626 | 2/1974 | (CA) . |
| 1040452 | 10/1978 | (CA) . |
| 1065154 | 10/1979 | (CA) . |
| D. 47747 | 1/1981 | (CA) . |
| D. 50020 | 7/1982 | (CA) . |
| D. 51160 | 4/1983 | (CA) . |
| D. 51313 | 5/1983 | (CA) . |
| D. 51794 | 9/1983 | (CA) . |
| 1182295 | 2/1985 | (CA) . |
| 1188116 | 6/1985 | (CA) . |
| 1194703 | 10/1985 | (CA) . |
| 1197391 | 5/1986 | (CA) . |
| 1204296 | 5/1986 | (CA) . |
| D. 58648 | 5/1987 | (CA) . |
| D. 58649 | 5/1987 | (CA) . |
| D. 62875 | 4/1989 | (CA) . |
| D. 63365 | 5/1989 | (CA) . |
| D. 63366 | 5/1989 | (CA) . |
| D. 66760 | 8/1990 | (CA) . |
| D. 67904 | 1/1991 | (CA) . |
| 2012286 | 9/1991 | (CA) . |
| 205452 | 9/1939 | (CH) . |
| 657 172 | 8/1986 | (CH) . |
| 669 001 | 2/1989 | (CH) . |
| 22 59 654 | 6/1974 | (DE) . |
| 18 11 932 | 6/1978 | (DE) . |
| 27 55 833 | 7/1978 | (DE) . |
| 27 19 107 | 11/1978 | (DE) . |
| 28 41 001 | 4/1980 | (DE) . |
| 34 01 629 | 7/1984 | (DE) . |
| 90 15 196 | 2/1991 | (DE) . |
| 296 10 306 U | 10/1996 | (DE) . |
| 0 039 372 | 11/1981 | (EP) . |
| 0 130 921 | 1/1985 | (EP) . |
| 0 170 113 | 7/1985 | (EP) . |
| 0 215 991 | 9/1985 | (EP) . |
| 0 322 668 | 12/1988 | (EP) . |
| 0 362 110 | 4/1990 | (EP) . |
| 0 490 534 | 6/1992 | (EP) . |
| 0 649 714 | 4/1995 | (EP) . |
| 392 474 | 11/1908 | (FR) . |
| 1 360 872 | 4/1963 | (FR) . |
| 2 228 900 | 5/1974 | (FR) . |
| 2 243 304 | 9/1974 | (FR) . |
| 2 343 871 | 5/1976 | (FR) . |
| 2 409 351 | 6/1976 | (FR) . |
| 2 422 780 | 12/1978 | (FR) . |
| 2 463 237 | 8/1979 | (FR) . |
| 2 465 032 | 9/1979 | (FR) . |
| 2 476 179 | 8/1981 | (FR) . |
| 2 561 684 | 9/1985 | (FR) . |
| 2 622 227 | 12/1989 | (FR) . |
| 2 675 835 | 10/1992 | (FR) . |
| 336 | of 1871 | (GB) . |
| 107 338 | 7/1917 | (GB) . |
| 248234 | 3/1926 | (GB) . |
| 420677 | 12/1934 | (GB) . |
| 536434 | of 1940 | (GB) . |
| 537153 | 6/1941 | (GB) . |
| 944066 | 12/1963 | (GB) . |
| 970595 | 9/1964 | (GB) . |
| 1 385 207 | 1/1975 | (GB) . |
| 1 386 088 | 3/1975 | (GB) . |
| 1 477 139 | 6/1977 | (GB) . |
| 2 091 775 | 8/1982 | (GB) . |
| 2 127 872 | 4/1984 | (GB) . |
| 2 213 095 | 8/1989 | (GB) . |
| 341611 | of 1936 | (IT) . |
| 456776 | 4/1950 | (IT) . |
| 0709599 | 6/1966 | (IT) . |
| 92167 | 7/1948 | (NZ) . |
| 151299 | 4/1969 | (NZ) . |
| 218830 | 9/1989 | (NZ) . |
| 215196 | 12/1989 | (NZ) . |
| 24781 | 5/1993 | (NZ) . |
| 25131 | 6/1994 | (NZ) . |
| 25132 | 6/1994 | (NZ) . |
| 25133 | 6/1994 | (NZ) . |
| 27313 | 6/1996 | (NZ) . |
| 27314 | 6/1996 | (NZ) . |
| 27315 | 6/1996 | (NZ) . |
| 27316 | 6/1996 | (NZ) . |
| 27317 | 6/1996 | (NZ) . |
| 27318 | 6/1996 | (NZ) . |
| 27346 | 9/1996 | (NZ) . |
| 27675 | 9/1996 | (NZ) . |
| 27676 | 9/1996 | (NZ) . |
| 27677 | 9/1996 | (NZ) . |
| 678160 | 12/1977 | (SU) . |
| 1145106 | 3/1985 | (SU) . |
| 1500005 | 12/1986 | (SU) . |

OTHER PUBLICATIONS

Besser Accessories Catalog.

Besser, Concrete Paving Stones, Manual No. 8601 — Section 5, Besser Company, pp. 1–24.

Besser, Parts and Equipment, Besser Company, pp. 1–80 (before 1990).

Besser, Technical Data for the Blockmaker, Besser Research and Training Center, pp. 33 and 34 (1962).
Bulletin 7062, Jul. 1, 1994.
Diamond Block Test Report to University of Wisconsin, Platteville (1990).
*Diamond Wall* System Installation Guide, Diamond Wall System, Block Systems, Inc. (1989).
*Diamond Wall Systems: The Cutting Edge*, Anchor Block Co. (date unknown).
*EZ Wall Systems* Product Literature, Rockwood Retaining Wall Systems, Inc. (date unknown).
*Garden Wall* Product Literature (1991).
*Handy–Stone Retaining Wall System* Product Literature (date unknown).
Installation & Design Manual, Rockwood Classic, The one–piece easy to use system, Rockwood Retaining Walls, Inc.
*Johnson Block* Product Literature (date unknown).
Keystone International Compac Unit Product Literature (1992).
Keystone® Retaining Wall Systems, Inc. —Heritage Stone Straight (Brochure, 2 pages); date unknown.
*Modular Concrete Block*, the Besser Co. (date unknown).
Orco Block Co., *Split Face Block*, the Besser Co. (date unknown).
*Paving Stone: New Lock With Old World Charm*, the Besser Co. (date unknown).
Pisa II, Interlock Retaining Wall System, Interlock Paving Company, (1988).
A Review of Paver Production on Besser Block Machines, Lucus E. Pfeiffenberger, pp. 33–37, (1984) (2 parts).
Single–element retaining wall system is ideal for block producers, Robert L. Hubler, Jr., Sep., 1983.
*Versa Lock* Product Literature (date unknown).
*Windsor Stone* Product Literature, Block Systems, Inc. (1991).
Allan Block™ advertisement, *Landscape Architecture*, The Landscape of Noguchi, Apr. 1989 (2 pages).
Allan Block™ advertisement, *Landscape Archecture*, Campus Design, Dec. 1989 (3 pages).
Allan Block, Inc. "New Mortarless Block Retaining Wall System" (New product announcement in *Concrete Products*, Mar. 1989, 2 pages.
Besser (QLD) Limited —Terreace Block (Brochure, 2 pages); date unknown.
Besser Tasmania Pty. Ltd. —Besser —Crib Wall (Brochure, 4 pages); date unknown.
Blaha, "Retaining Wall System Keyed to Success", *Concrete Products*, 91(2):60–61 (Feb. 1998).
Block System Incorporated —"Beautify Your Landscape" (Advertisement, 1 page); date known.
Bowen Building Block & Supply Co, —price sheet and diagram (2 pages); date unknown.
Brik Block Industries —Color Crib Wall (Brochure, 4 pages); date unknown.
Cavitex Concrete Masonry Ltd. —Concrib™ (Brochure, 2 pages); date unknown.
Columbia Machine, Inc. —Retaining Wall Block (Brochure, 2 pages); date unknown.
Columbia Machine, Inc. —Slope and Road Paving Block (Brochure, 14 pages); date unknown.
Cribwalling —Techniques and Design Considerations, N.Z. *Portland Cement Association* (Article, 12 pages); Apr. 1970.
Dura—Hold ® Interlock Retaining Wall System for Heavy Duty Protection (Brochure, 2 pages); date unknown.
Federal Court of Australia, Exhibit "CFM–4" sketch (2 pages); Oct. 8, 1996.
Federal Court of Australia, Exhibit "CFM–7"—sketch (2 pages); Oct. 8, 1996.
Federal Court of Australia, Exhibit "D"—Advanced Concrete Technology Features New Design! (2 pages); Oct. 14, 1996.
Flittie/Marshall Concrete Products, Inc. —Stonescape™ Retaining Wall System (2 pages); date known.
Gehring, "Erosion control system produced on a block machine"(Article, 3 pages); date unknown.
Heinzmann Kunststeinwerke—Barrier Wall (Brochure, 5 pages); date unknown.
Heinzmann Kunststeinwerke—Embankment Brick System (Brochure, 3 pages); date unknown.
Humes Limited—Precast Concrete (Brochure, 20 pages); date known.
Jatal Industries, Inc.—Earthstone™ Retaining Wall Stores (Brochure, 2 pages); date unknown.
"Jewell Concrete Products, Inc. Expands to New Markets-"*Besser Block*, Fall 1988, 12:(3).
Jumbo Nursery Stone™ Hard Working Retaining Walls (2 pages); date unknown.
Kawano Cement Brochure (date unknown).
Keystone Retaining Wall Systems Product Literature (1992).
Krehling Industries article, Florida block and r/m plant relies on admixtures, 1 page, date unknown.
Kronimus Betonsteinwerke—Flora Kron System (Brochure, 4 pages); date unknown.
Monior Masonry—Permacrib Supports the Earth (Brochure, 10 pages); date unknown.
Nanazashvily, I.K., "Stroitelnye materialy is drevesho–cementnoy kompozitsii," 1 page, (1990). (showing illustration of reed–concrete block in cross –section).
PISA II®,Interlocking Retaining Wall System for Garden Landscaping (Brochure, 2 pages); date unknown.
"Product News,"from *Landscape Archecture*, Aug. 1989 (3pages).
Profile HEX Masonry Units literature, 1 page, date unknown.
Risi Stone Ltd.—Dura—Crib® Interlocking Retaining Wall System (Brochure, 4 pages); date illegible.
Rockwood Retaining Walls, Inc.—EZ Wall Systems (Brochure, 2 pages); date unknown.
Rockwood Retaining Walls, Inc.—Rockwood Classic Retaining Wall System—"Shaping the world around us" (4 pages); date unknown.
Rocia—Lo Crib (Brochure, 4 pages); date unknown.
Rocia Concrete Pipes Limited—Pinned Cribbing (Brochure, 12 pages); Jun. 1971.
Rocia Masonry—Unibank Creative Embarkment—Inspired By Nature (Brochure, 6 pages); May 1995.
SF Kooperation (Corporate Report, 26 pages); date unknown.
SF Kooperation GmbH—Eskkoo®—Kleine Kreuzwand (Brochure, 2 pages); date unknown.
"Straβenbau Heute—Vorgefertigte Beton—Bauteile" (3 page); date unknown.
Tubag Trass—,Zement und Steinwerke Gmbh—Tubawall® (Brochure, 6 pages); date unknown.
Uni—Uni—Multiwall (Brochure, 2 pages); date unknown.
Various Diamond Wall System 4 and 4.4 Concrete Masonry Units Tech Specs, Anchor Block, 4 pages, (1988, 1989).
Winstone—Soil Stabilisation and Erosion Control System (Brochure, 9 pages); date unknown.

* cited by examiner

SPLITTING TECHNIQUE

This application is a Continuation of application Ser. No. 08/774,247, filed Nov. 8, 1996, which application are incorporated herein by reference.

BACKGROUND

The process of splitting away a portion of a concrete masonry unit to provide a decorative "rockface" to the finished unit is well-known. In the case where the finished rockface is planar, it has not been uncommon to provide a linear splitting groove or pattern on the uppermost surface of the pre-split unit to aid in the splitting process.

Anchor Wall Systems, Inc. ("AWS"), my assignee, forms a faceted or "three-way" split face on some of its concrete retaining wall units. The process first requires that a pre-split concrete masonry unit be formed by a block machine. The pre-split unit must be larger than the finished unit, so that a portion of it can be split away to form the decorative face. If the block machine is large enough, the pre-split unit comprises what will ultimately be two retaining wall blocks, joined face-to-face. Otherwise, the pre-split unit comprises the finished unit with a sacrificial portion joined to its face. Some of the AWS retaining wall units, such as the ANCHOR WINDSOR STONE®, ANCHOR DIAMOND®, and DIAMOND PRO™, are formed with lips to facilitate the locating of the blocks in a wall. Since the block machine forms the units on flat, horizontal metal pallets, the pre-split units are cast with the lips facing up.

After a pre-split unit is formed in the block machine, it is hardened by any one of a variety of curing techniques, until it has attained a suitable hardness for splitting. It is then split in a splitting machine. The unit is carried into the splitting station on a roller conveyor. It is supported there by a divided receiving plate. The splitting is typically accomplished with a top knife, which is driven down onto the pre-split unit, in combination with an opposed bottom knife and opposed side knives.

In the case of the three-way split, the top and bottom knives are formed in the shape of a "crow's foot", comprising a straight center section joining two diverging V-shaped portions. Up until now, AWS has molded vertical splitting grooves, which define the rearward edges of the return facets on the finished units, into the sides of the pre-split units. The side knives engage these grooves during the splitting process.

Heretofore, AWS has not formed any type of splitting groove or pattern into the top surface of a presplit unit which is to be split to form faceted faces on the finished units, and, in particular, has not formed any such patterns by the compressive action of a stripper shoe plate carrying appropriate tooling.

I have noted several shortcomings of the current system. It is difficult to create a face with an extended straight section and relatively short returns, particularly on the taller products. For example, AWS' current ANCHOR WINDSOR STONE® product is a four inch high block, twelve inches wide. The center section of the face is eight inches wide and the return sections are each two inches wide in front projection. AWS' current ANCHOR DIAMONDS® product is a six inch high block. The center section of the face is eight inches wide and the return sections are each four inches wide in front projection. AWS has not experienced unusual difficulty in splitting these faces to the stated proportions if side knives are employed in combination with a top knife. However, AWS would like to increase the length of the center section of the ANCHOR DIAMOND® block to twelve inches, with approximately two inch returns (front projections). AWS has experienced difficulty in consistently splitting off such small wedges from the six inch tall product with standard automated splitting equipment. If the return splits are not acceptable, then the blocks must be manually dressed to make them acceptable, which increases the labor costs.

AWS would also like to minimize the need to use side knives, especially during the splitting of the ANCHOR WINDSOR STONE® product. This is because elimination of the side knives would permit the manufacturer to position two pre-split units in the splitter side-by-side, and thus create four split units with one stroke of the splitter.

Another problem is that as the block gets taller, it gets more difficult to get good return splits, regardless of how long the wedge is. For example, AWS' DIAMOND PRO™ blocks are eight inch tall products. The center section of the face of each is twelve inches wide, and the returns are three inches wide in front projection. It is difficult to consistently split the three inch wide returns on these products using conventional equipment and techniques.

SUMMARY OF THE INVENTION

I have found that I can improve the three-way splitting of our retaining wall products if I form a splitter guide pattern in the top surface of the pre-split concrete masonry unit. The guide pattern comprises a splitting groove which corresponds in length and orientation with the intended plane of the center section(s) of the face(s) of the finished unit(s), and recessed regions generally corresponding in size and orientation with the top plan of the wedges of material that need to be split from the pre-split units to create the return sections of the face(s) of the finished unit(s).

In the case of a pre-split unit comprising two identical finished units joined face-to-face, the splitting groove is formed transversely of the longitudinal axis of the unit, and along an axis of symmetry of the top surface of the pre-split unit. The splitting groove intersects recessed areas at each side edge of the top surface of the pre-split unit.

The splitting pattern is formed in the pre-split unit by the compressive action of the stripper shoe plate during the molding action of the block machine. Appropriate raised surfaces are formed on the plate to form the pattern.

DETAILED DESCRIPTION

The pre-split concrete masonry units are preferably formed in a conventional block machine, such as the V3/12 and DYNAPAC model machines, produced by Besser Co. of Alpena, Mich., and then are cured. The ANCHOR WINDSOR STONE® pre-split units may be formed generally as described in U.S. Pat. No. 5,249,950, which is incorporated herein by reference. The ANCHOR DIAMOND® and DIAMOND PRO™ pre-split units may be formed generally as described in U.S. Pat. No. 5,062,610, which is incorporated herein by reference.

Figure 1:
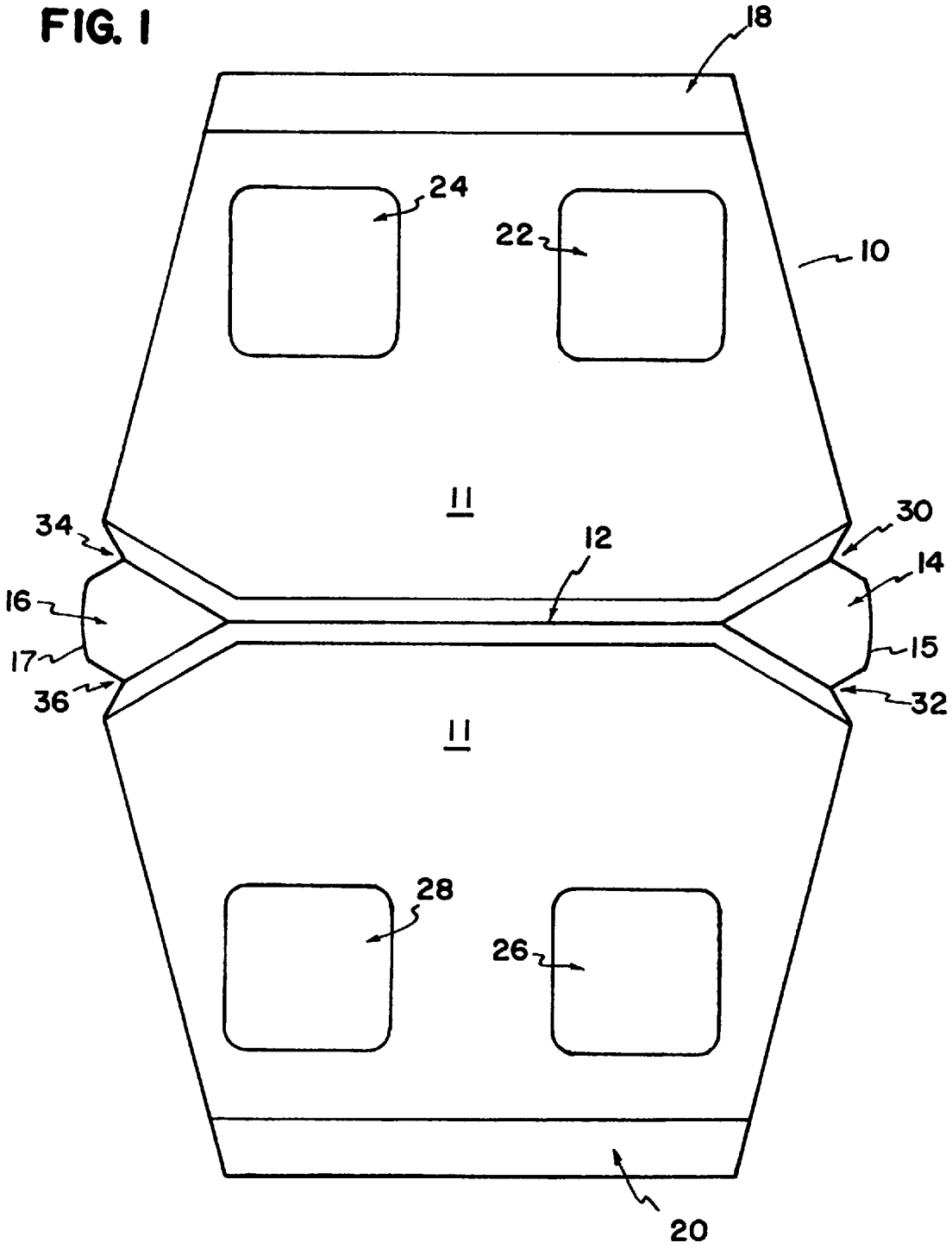
FIG. 1 is a plan view of the top, or "lips-up", side of a pre-split concrete masonry unit, (CMU), according to one aspect of my invention.

The process as described in the aforesaid patents is modified by forming a splitting pattern on the top, or "lips-up", surface 11 of the pre-split concrete masonry unit ("CMU",). A CMU according to my invention is shown at reference numeral 10 in FIG. 1. As shown in FIG. 1, the splitting pattern comprises a transverse splitting groove 12, which intersects the two triangular-shaped recessed regions 14 and 16 formed in the top surface 11. The first triangular-shaped recessed region 14 has a side 15 that is adjacent to the side edge of the CMU's top surface 11, and the second triangular-shaped recessed region 16 has a side 17 that is adjacent to the opposite side edge of the CMU's top surface 11. The pattern is formed in the pre-split unit by the compressive action of the stripper shoe plate on the compacted mix held in the mold box. Appropriate raised surfaces are affixed to the face of the stripper shoe plate to accomplish this compressive, pattern forming action. Preferably, the depth of the splitting pattern on the pre-split unit is between ¼ inch and 1 inch, and more preferably is between ¼ inch and ½ inch. Other features of the CMU 10 are a pair of lips 18 and 20 integrally formed at the opposite ends of the top surface of the CMU, cores 22, 24, 26, and 28, and side grooves 30, 32, 34, and 36.

In the preferred embodiment, splitting grooves 12, 30, 32, 34, and 36 are V-shaped grooves, with side walls each oriented at about forty-five degrees from the horizontal, so that they intersect at an angle of about ninety degrees. In the regions of the recessed areas 14 and 16, where the splitting groove diverges, the side walls of the groove continue the same angular orientation, to provide clearance for the splitter blade, which is preferably formed with a sixty degree working edge.

The splitting may be accomplished in a splitting machine, such as those available from the Lithibar Matik company of Holland, Mich. I prefer to cure the pre-split CMU to a compressive strength of about between about 800 and 1750 psi, and more preferably, between about 1000–1200 psi. I adjust the splitting pressure in accordance with the standard skill in the art. I also prefer to use side knives and a bottom knife. In the case of the CMU 10, I prefer to have side knives contact the unit at the four side grooves 30, 32, 34, and 36, just prior to the stroke of the top knife and the bottom knife, which is a mirror image of the top knife. The bottom knife intersects the bottom surface of the CMU in planes corresponding to those intersected on the top surface by the top knife.

I have found that the technique works with symmetric pre-split units which will create two essentially identical finished units. This type of pre-split unit is shown in FIG. 1.

Figure 2:
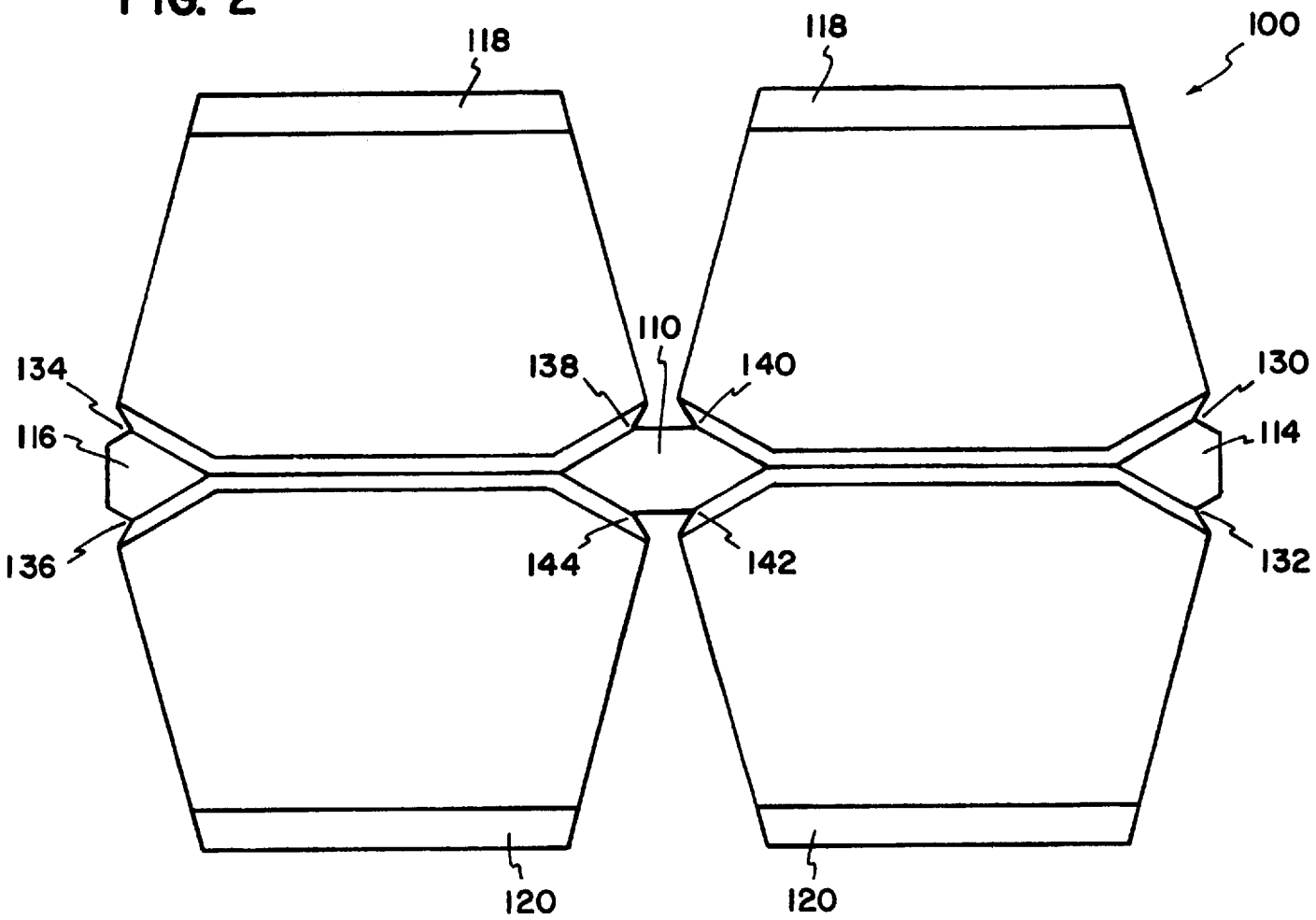
FIG. 2 is a plan view of the top, or "lips-up", side of a pre-split concrete masonry unit according to an additional aspect of my invention.
Figure 3:
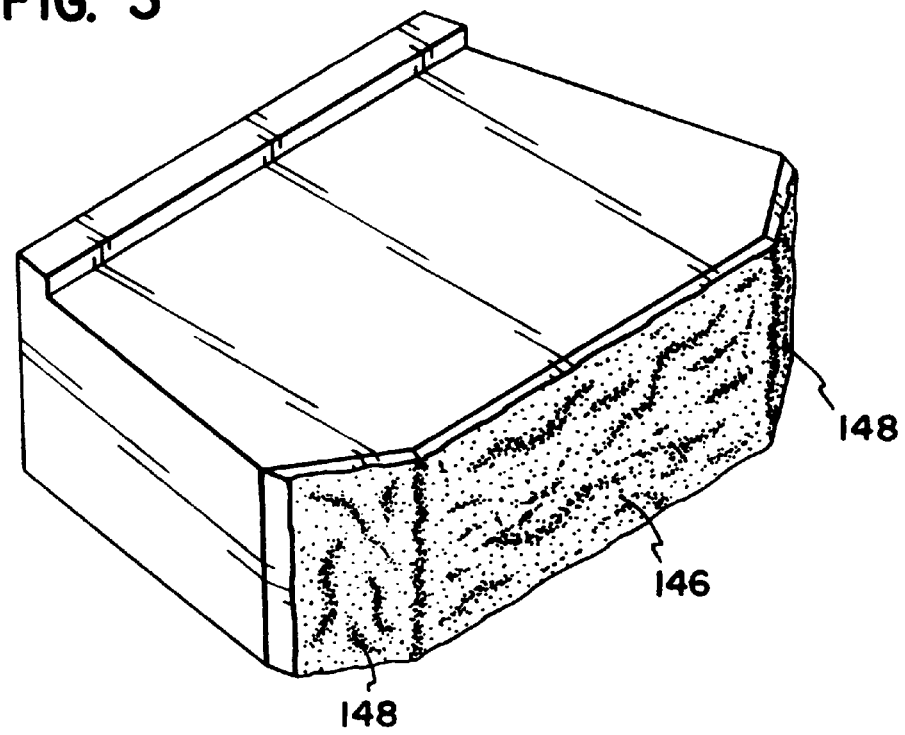
FIG. 3 is a perspective view of the "lips-up", side of a finished retaining wall block according to my invention showing the chamfer formed by the splitting pattern.

I have also found that the technique works with symmetric pre-split units which will create four essentially identical finished units. This type of pre-split unit is shown at reference numeral 100 in FIG. 2. Unit 100 is essentially two of the units 10 attached side-by-side by means of web 110 (without cores). Web 110 is preferably formed of the same composite fill material used to form the remainder of the CMU, and is formed during the molding process. The top, or "lips-up", surface of the web is recessed in the same manner as previously described with respect to the triangular-shaped recesses 14 and 16 shown in FIG. 1, shown as 114 and 116 in FIG. 2. Again block lips are seen at 118 and 120. When CMU 100 is aligned in the splitter, with appropriate splitter blades, it will yield four finished units with each stroke of the splitter.

When splitting CMU 100, it is preferred to use top and bottom knives as previously described, and opposed side knives at the outside grooves 130, 132, 134, and 136. No side knives are used at the inside grooves 138, 140, 142, and 144. I have found that recessing the top surface of the attaching web 110 produces a good quality split on these inside edges without the necessity of side knives, which requires minimal, if any hand dressing.

Figure 4:
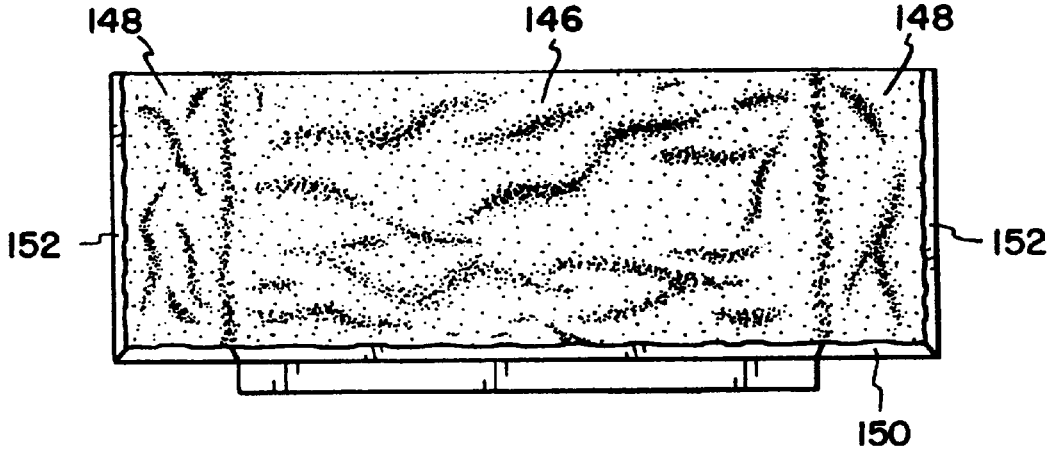
FIG. 4 is a front elevation of a finished retaining wall block made using my invention.
Figure 5:
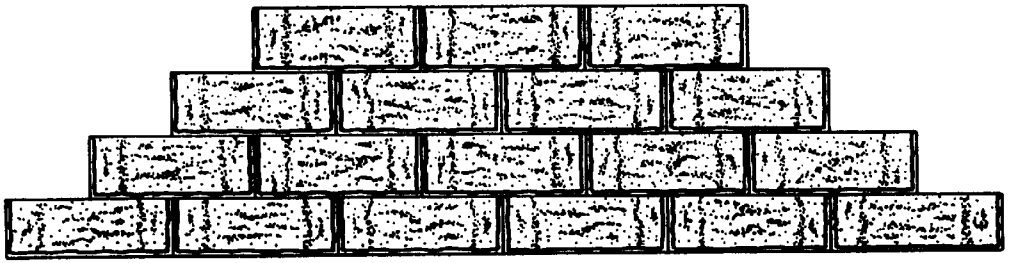
FIG. 5 is a front elevation of a retaining wall using a block made using my invention.

By using this splitting pattern technique, I have found that I can consistently produce four of our ANCHOR WINDSOR STONE® units with one stroke of the splitter. The finished units have a face height of about four inches and a face width of about twelve inches. The center section 146 of the face is about eight inches in width, and the projected width of each return section 148 is about two inches, FIG. 4. The splitting action creates broken surfaces on the center and return faces of the block, except in the chamfer regions 150, 152 along the lower and side edges of the front face. This chamfer 150 is formed by the remnant of the splitting pattern. When this block is oriented as it would be when layed up in a wall, the wall has the appearance shown in FIG. 5.

I know of no reason why the technique will not work with asymmetric pre-split units which are designed to produce one long unit and one short unit with essentially identical faces, or with an asymmetric pre-split unit, which is designed to produce one finished unit, and a sacrificial piece.

Figure 6:
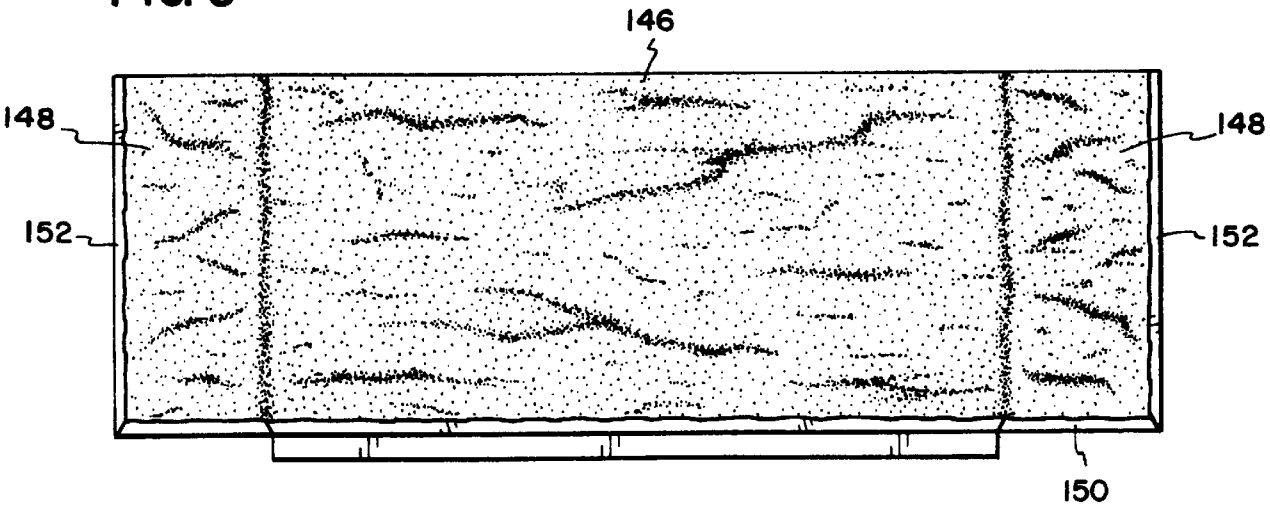
FIG. 6 is a front elevation of a Diamond® block made using my invention.

By using this splitting pattern technique, I have found that I can consistently produce two of our ANCHOR DIAMOND® units (six inches tall), having an extended center section 146 of twelve inches and returns 148 having a projected width of about two inches each, with minimal hand dressing of the units needed. The finished unit is shown in FIG. 6.

Figure 7:
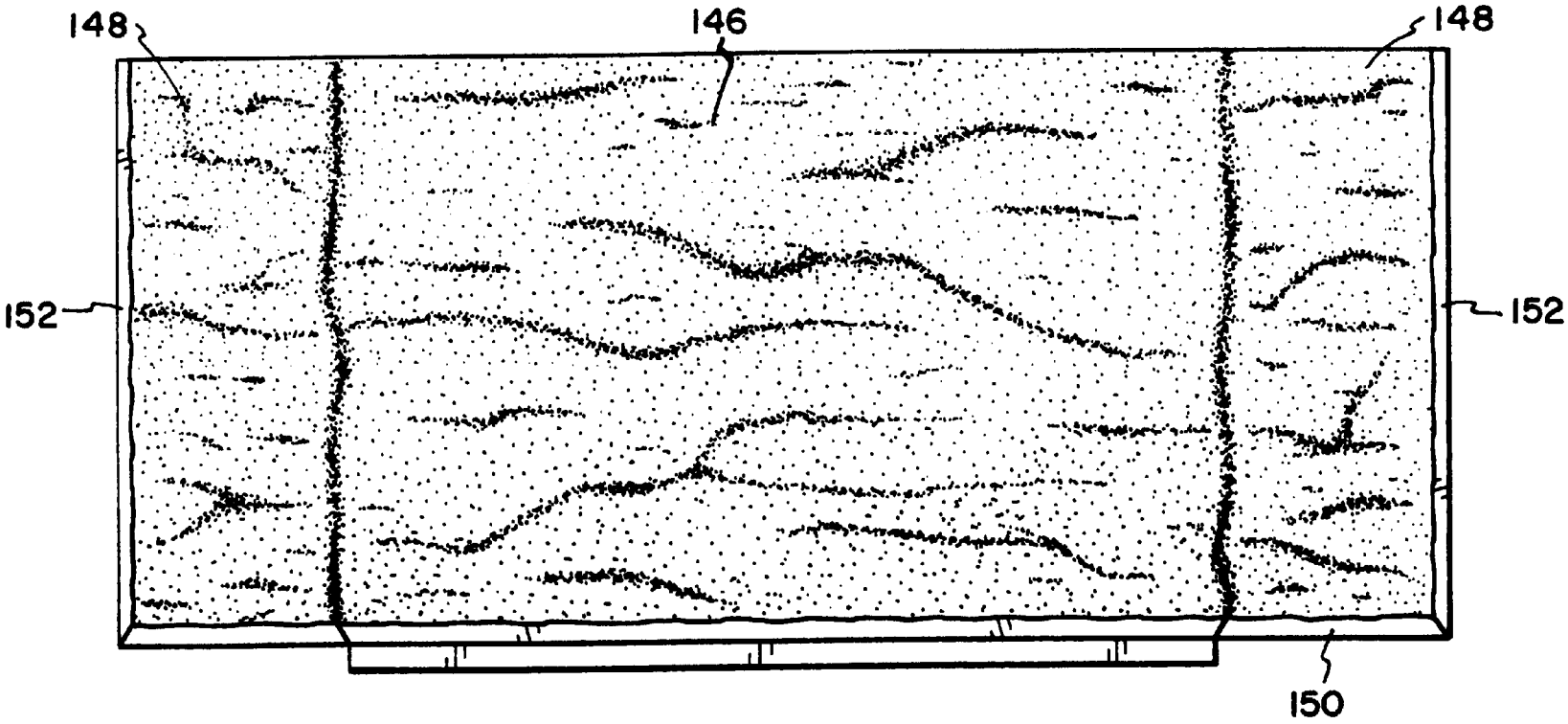
FIG. 7 is a front elevation of a Diamond Pro® block made using my invention.

By using this splitting pattern technique, I believe that I can consistently produce two of our DIAMOND PRO™/ units (eight inches tall), having an extended center section 146 of twelve inches and returns 148 having a projected width of about three inches each, with minimal hand dressing of the units needed. The finished unit is shown in FIG. 7.

I have found, by using this technique, that I can achieve a more subtle, aesthetically-pleasing look on our taller blocks, (DIAMOND and DIAMOND PRO™) due to our ability to make the shorter return facets. I have also found that the unbroken remnant of the splitting pattern which remains on the finished faces creates a pleasing chamfer on the lower and side edges of the finished faceted face. I have found that this chamfer, in combination with the shorter returns and the course-to-course setback when the blocks are formed into a wall, creates a unique look that has not heretofore been achieved in faceted retaining walls.

The above specification, examples and data provide a complete description of the manufacture and use of the composition of the invention. Since many embodiments of the invention can be made without departing from the spirit and scope of the invention, the invention resides in the claims hereinafter appended.

The claimed invention is:

1. A concrete masonry unit comprising a top surface and a bottom surface, said top surface having formed therein a splitting pattern comprising a splitting groove which extends to, and forms at least a partial border of, at least one recessed region formed in the top surface, and wherein said top surface and said bottom surface are parallel.

2. The concrete masonry unit of claim 1 wherein the splitting groove extends to, and forms at least a partial border of, at least two recessed regions formed in the top surface of the unit.

3. The concrete masonry unit of claim 2 wherein at least two of the recessed regions are of generally triangular shape.

4. The concrete masonry unit of claim 3 wherein the top surface comprises opposed side edges, and one of said triangular recessed regions is located along one side edge of the top surface, and another of the triangular recessed regions is located along the opposed side edge of the top surface.

5. The concrete masonry unit of claim 4 wherein the splitting groove extends along a line defining an axis of symmetry for each triangular-shaped recessed region.

6. The concrete masonry unit of claim 3 wherein the splitting groove defines an approximate axis of symmetry of the top surface of the unit.

7. The concrete masonry unit of claim 1 wherein the splitting pattern is formed by compressive action on the top surface of the unit prior to curing of the unit.

8. A concrete masonry unit according to claim 7 wherein the top surface includes at least one upstanding lip formed thereon.

9. A concrete masonry unit comprising a top surface having first and second opposed side edges, and including a first recessed region located at the first side edge.

10. The concrete masonry unit of claim 9 wherein the first recessed region is triangular in shape, with one side of the triangle aligned with the first side edge of the top surface.

11. The concrete masonry unit of claim 10 further including a second recessed region located at the second side edge.

12. The concrete masonry unit of claim 11 wherein the second recessed region is triangular in shape, with one side of the second recessed triangle is aligned with the second side edge of the top surface.

13. The concrete masonry unit of claim 12 further comprising a splitting groove formed in the top surface and joining the first and second recessed regions.

14. A concrete masonry unit according to claim 13 wherein the top surface includes at least one upstanding lip formed thereon.

15. A concrete masonry unit according to claim 14 wherein the top surface includes at least two upstanding lips formed thereon.

16. A concrete masonry unit comprising two substantially identical units as described in claim 13 joined together in a side-by-side relationship by means of a web of concrete masonry material located in the region of a recessed region on each unit.

17. A concrete masonry unit according to claim 9 wherein the top surface includes at least two upstanding lips formed thereon.

18. A concrete masonry unit comprising:

a) a lower face;

b) an upper face generally parallel to the lower face;

c) opposed front and rear faces, each being generally perpendicular to the upper and lower faces, and joining the upper and lower faces;

d) opposed first and second side faces, each being generally perpendicular to the upper and lower faces, and joining the upper and lower faces; and e) a splitting pattern formed in the upper face, comprising i) a first triangularly-shaped, recessed splitting region located at the intersection of the upper face and the first side face;

ii) a second triangularly-shaped, recessed splitting region located at the intersection of the upper face and the second side face; and iii) a splitting groove extending generally parallel to the front and rear faces and joining the first and second recessed splitting regions.

19. The concrete masonry unit of claim 18 wherein the side faces each include a sacrificial portion and rearwardly converging portions, the sacrificial portions being generally parallel to each other, and the rearwardly converging portions extending from the sacrificial portions to the rear face and converging towards each other as they approach the rear face.

20. The concrete masonry unit of claim 19 wherein the length of the sacrificial portion of the first side face corresponds in length with that of the first recessed splitting region, and the length of the sacrificial portion of the second side face corresponds in length with that of the second recessed splitting region.

21. The concrete masonry unit of claim 20 further including a lip extending upwardly from the top face along its intersection with the rear face.

22. The concrete masonry unit of claim 21 wherein the first and second side faces further include front portions extending from the sacrificial portions to the front face and converging towards each other as they approach the front face.

23. The concrete masonry unit of claim 22 further including a lip extending upwardly from the top face along its intersection with the front face.

24. A method of forming a concrete masonry unit, said concrete masonry unit comprising:

a) a lower face;

b) an upper face generally parallel to the lower face;

c) opposed front and rear faces, each being generally perpendicular to the upper and lower faces, and joining the upper and lower faces;

d) opposed first and second side faces, each being generally perpendicular to the upper and lower faces, and joining the upper and lower faces; and e) a splitting pattern formed in the upper face, comprising i) a first triangularly-shaped, recessed splitting region located at the intersection of the upper face and the first side face;

ii) a second triangularly-shaped, recessed splitting region located at the intersection of the upper face and the second side face; and iii) a splitting groove extending generally parallel to the front and rear faces and joining the first and second recessed splitting regions, said method comprising the step of forming said first and second recessed splitting regions and said splitting groove by compressive action on the top surface of the unit prior to curing of the unit.

* * * * *